US005178594A

United States Patent [19]

Wu

[11] Patent Number: 5,178,594

[45] Date of Patent: Jan. 12, 1993

[54] WORK CONTROL APPARATUS IN AN EXERCISER

[76] Inventor: Mu-Chuan Wu, No. 23, Hai Huan Street, Tainan, Taiwan

[21] Appl. No.: 906,408

[22] Filed: Jun. 30, 1992

[51] Int. Cl.[5] ..... A63B 22/06; A63B 21/005

[52] U.S. Cl. ..... 482/63; 482/903; 482/5

[58] Field of Search ..... 482/57, 63, 64, 4, 5, 482/903; 310/105, 106, 104, 191; 73/862.17, 862.18

[56] References Cited

U.S. PATENT DOCUMENTS 5,016,871 5/1991 Dalebowt et al. ..... 482/5
5,076,573 12/1991 Lo ..... 482/903
5,094,447 3/1992 Wang ..... 482/903
5,145,480 9/1992 Wang ..... 482/5

*Primary Examiner*—Stephen R. Crow
*Attorney, Agent, or Firm*—Pro-Techtor International

[57] ABSTRACT

A work control apparatus in a bicycle exerciser having a driven member made of inductive material and rotatively mounted on an exerciser frame. The work control apparatus includes a fixing shaft pivotally connected to the exerciser frame and fixedly carrying a pulley member and a box-shaped support portion, a U-shaped permanent magnet secured to the support portion and a rotatively mounted knob connected to the pulley member by an endless belt for selectively locating the permanent magnet in one of a plurality of angular positions. Part of the driven member is interposed between two spaced legs of the permanent magnet to generate an eddy current in the driven member for exerting a rotation resistance on the driven member.

1 Claim, 3 Drawing Sheets

WORK CONTROL APPARATUS IN AN EXERCISER

BACKGROUND OF THE INVENTION

The present invention relates to improvements in a work control apparatus in an exerciser, and more particularly to an improved apparatus in a bicycle exerciser which permits easy and ready adjustment of a brake to a predetermined blocking force on a driven wheel.

In the heretofore conventional work control apparatus utilized in an exerciser of this type, the control knob, which was used to regulate the braking pressure was also used to indicate the braking pressure. The full range of pressure adjustment required that the knob be rotated a considerable number of revolutions. Thus, it was extremely difficult to readjust the knob to a particular predetermined pressure, once the knob had been moved more than one revolution to provide a different pressure, simply by reliance upon the indicator provided on the knob.

SUMMARY OF THE INVENTION

An object of this invention is to provide a work control apparatus in an exerciser which can diminish the disadvantages of a know apparatus.

It is another object of this invention to provide a work control apparatus with a construction allowing for accurately simulating power based on a rolling resistance.

With the above objects in view, this invention provides a work control apparatus which obviates the inconvenience encountered hitherto, the structure of which comprises a fixing shaft pivotally connected to a frame of an exerciser, a sheave member nonrotatably mounted on the fixing shaft a support member nonrotatably mounted on the fixing shaft next to the sheave member, a permanent magnet of a depressed form, where part of a wheel of the exerciser is interposed, firmly attached to the support member, a manually-actuated knob rotatably connected to the frame of the exerciser and connected to the sheave member through an endless belt for selectively determining the rotational resistance exerted on the wheel of the exerciser.

DETAILED DESCRIPTION OF THE PREFERRED EMBODIMENT

Figure 1:
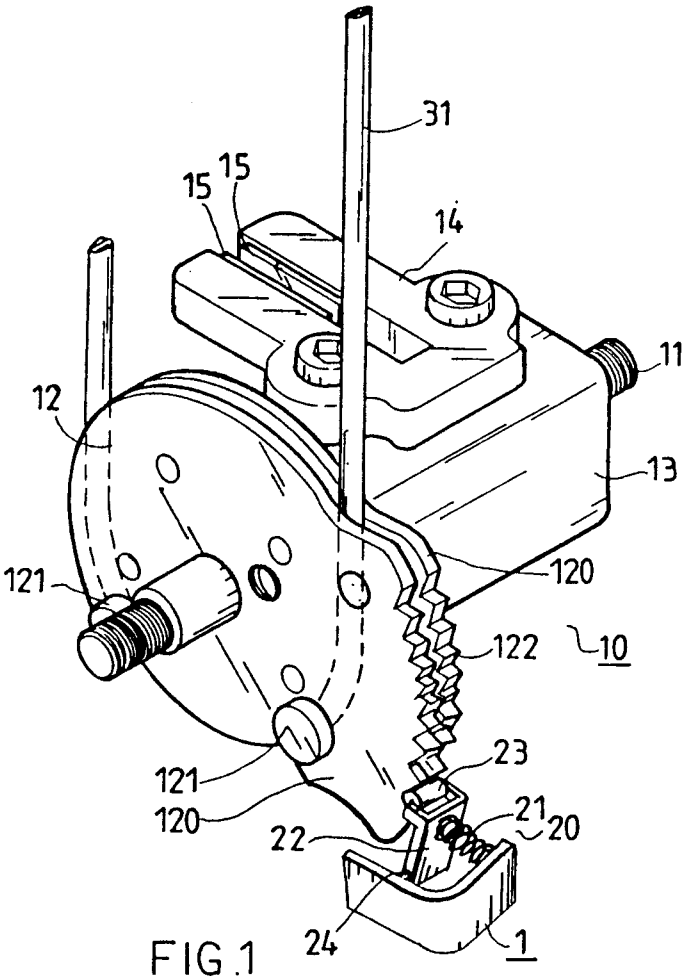
FIG. 1 is a perspective view of a work control apparatus according to the present invention.

It will be understood that the exerciser of this embodiment is a bicycle type. Referring now to FIG. 1, a work control apparatus according to the present invention includes a sheave member 12 with a grooved rim over which a wire or belt 31 passes. The sheave member 12 is nonrotatably mounted on a fixing shaft 11 which is pivotally connected to a frame 1 (only part of the frame 1 of the exerciser is shown in FIG. 1). Two fastening members such as bolts 121 are threaded into respective screw holes (not shown) in a side wall of the sheave member 12 and extended therethrough with inner ends of the bolts 121 abutting against the belt 31 to secure the belt 31 in position and prevent the belt 31 from a sliding movement with respect to the sheave member 12. A pair of eccentric walls 120 correspondingly and integrally formed on a section of the circumference of side walls of the sheave member 12. A series of teeth 122 is formed in an outer circumference of each of the eccentric walls 120.

A box-shaped support portion 13 for supporting a permanent magnet 14 on top thereof is nonrotatably mounted on the fixing shaft 11 next to the sheave member 12. The magnet 14 is of generally U-shaped configuration with two legs 15 defining a slot in between. A locating device 20 is provided for locating the sheave member 12 in association with the magnet 14 at one of a plurality of angular positions. The locating device 20 includes a roller frame 22 pivotally connected to the frame 1 fo the exerciser by means of a pivot pin 24. The remote end of the roller frame 22 is provided with a roller 23, which is rotatably mounted on a shaft (not shown) and adapted to engage a cog of the teeth 122 formed in the outer circumference of the eccentric walls of the sheave member 12. A compression spring 21 is provided between the roller frame 22 and frame 1 of the exerciser.

Figure 2:
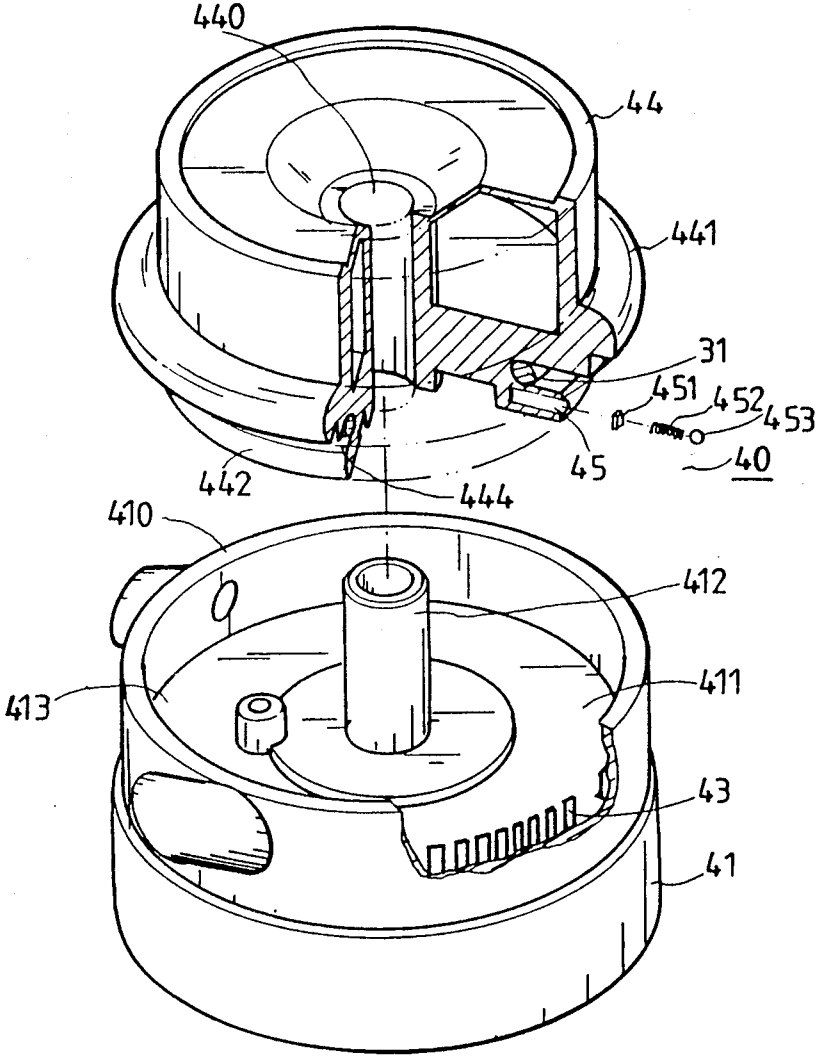
FIG. 2 is an exloded, partially broken, perspective view of a load selector to be used in the apparatus of the present invention.
Figure 3:
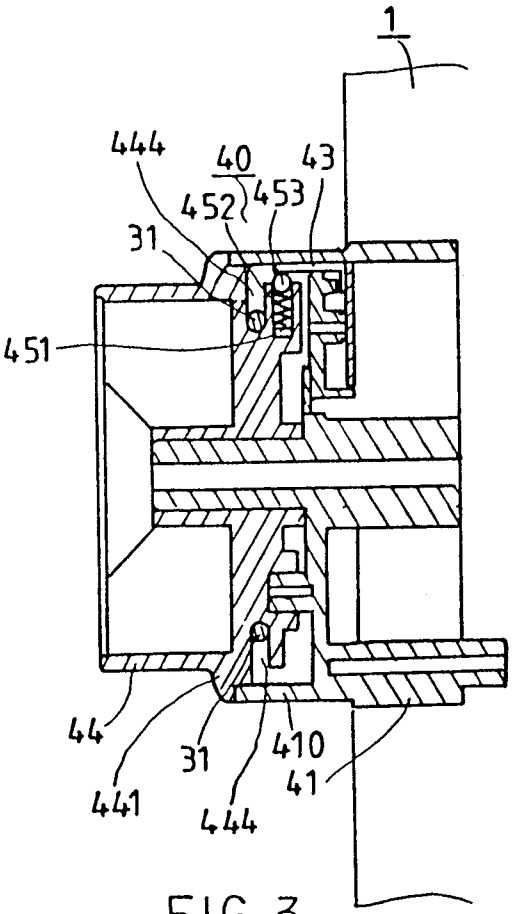
FIG. 3 is a cross-sectional view of the load selector which is in an assembled condition.

Referring to FIGS. 2 and 3, a load selector 40 for selectively positioning the work control apparatus 10 in one of a plurality of angular positions includes a stand 41 firmly received in the frame 1 of the exerciser and a manually-actuated knob 44 rotatably mounted on the stand 41. The stand 41 has a cylindrical wall 410 and a partition 411 defining a depression 413 on top end of the stand 41 and a spindle 412 raised axially from the partition 411. A plurality of contacts 43 made of copper sheet and corresponding in numeral with the teeth 122 are arranged along an inner surface of the cylindrical wall 410. The knob 44 defines an axial socket 440 for rotatably sleeved around the spindle 412 of the stand 41 and an annular groove 444 along the circumference thereof for receiving the endless belt 31 which interconnects the knob 44 and the sheave member 12, as best shown in FIGS. 3 and 4.

A bore 45 is formed radially within a neck portion 442 under an annular flange 441 of the knob 44 for sequentially accommodating a copper member 451, a coil spring 452 and a steel ball 453. The neck portion 442 of the knob 44 is disposed within the depression 413 of the stand 41 when mounting the knob 44 on to the stand 41 and so oriented that, when turning the knob 44 to drive the sheave member 12 to rotate through the belt 31, the steel ball 453 contacts one of the contacts 43 in accordance with the engagement of the roller 23 of the locating device 20 with a cog 122 of the teeth 122. An electronic indicator (not shown) can be provided with a circuit connected to the contacts 43 and the copper member 451 for displaying angular position of the work control apparatus 10 with a numerical indicia.

Figure 4:
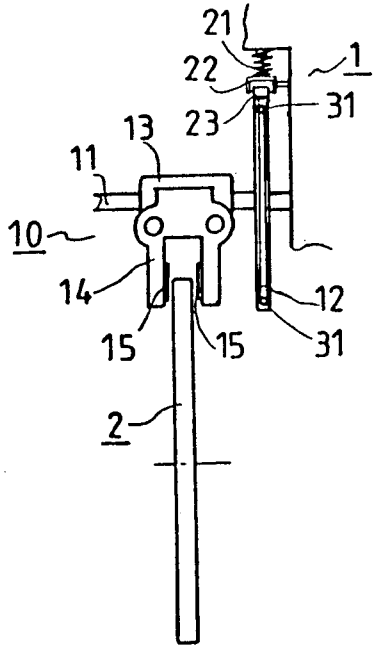
FIG. 4 is an elevational view of the load control apparatus together with a wheel of an exerciser.
Figure 6:
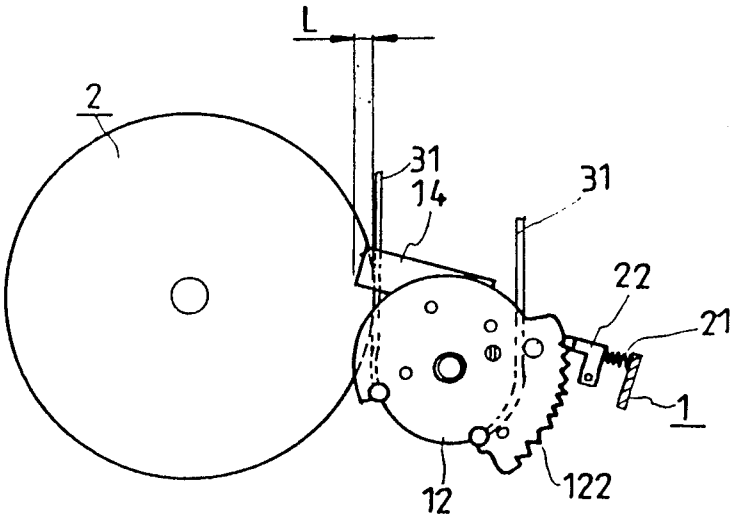
FIGS. 5 & 6 are a side elevation of the apparatus shown in FIG. 4 diagrammatically illustrating different angular positions of the apparatus with respect to the wheel.
Figure 5:
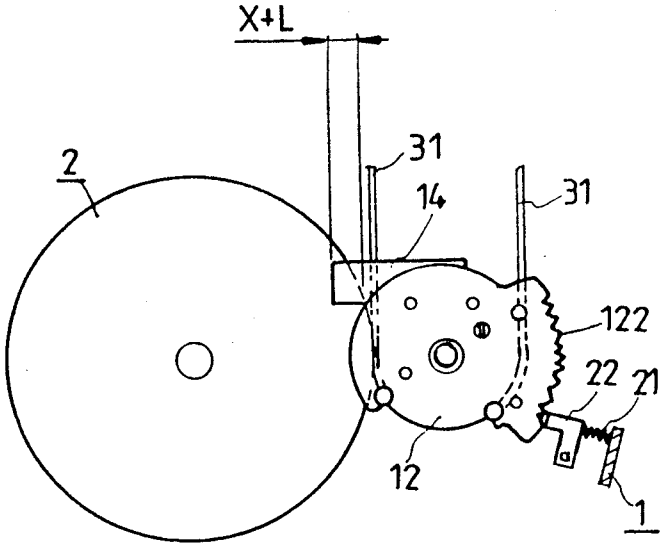

In application, as shown in FIGS. 4 to 6, the work control apparatus 10 is pivotally connected to the frame 1 of the exerciser by means of the fixing shaft 11 and a wheel 2 driven to rotate by an appropriate drive means such as a conventional foot pedal and sprocket-chain (not shown) connected thereto is partially interposed between the spaced legs 15 of the permanent magnet 14. Since the permanent magnet 14 constantly generates a magnetic field in a direction penetrating the wheel 2 which is made of inductive material such as copper, eddy current is generated in the wheel 2. This eddy current acts as a force for blocking rotating movement of the wheel 2. The blocking force, namely, rotation resistance can be changed by change of the angular position of the permanent magnet 14 with respect to the wheel 2.

As shown in FIGS. 5 and 6, the different areas of the magnetic field caused by the permanent magnet 14, namely, areas of overlap with the wheel 2 are set according to the different angular positions of the magnet 14 with respect to the wheel 2 by the roller of the roller frame 22 which is selectively engaged with one of the teeth 122 of the sheave member 12 to which the rotation of the knob 44 is transmitted by the endless belt 31. The work control apparatus so constructed thereby provides a very simple means of determining the laod on the wheel 2 of the exerciser.

I claim:

1. A work control apparatus in an exerciser having a frame, and a driven member made of inductive material and rotatively mounted on the frame, the apparatus comprising:

a fixing shaft pivotally connected to the frame;

an eccentric member non-rotatively mounted on the fixing shaft and having a projection defining a series of teeth in an outer circumference thereof;

an endless belt passing over a grooved rim of the eccentric member;

a substantially U-shaped permanent magnet;

means for non-rotatively mounting the permanent magnet onto the fixing shaft with part of the driven member interposed between two spaced legs of the permanent magnet; and a locating means having a roller frame pivotally connected to the frame of the exerciser, a roller adapted to be engaged with a cog of the teeth and a coil spring disposed between the roller frame and the frame of the exerciser and biasing the roller towards the cog.

* * * * *